US006041481A

United States Patent [19]

Martin

[11] Patent Number: 6,041,481

[45] Date of Patent: Mar. 28, 2000

[54] HOOK FOR PLEATING AND HANGING CURTAINS

[76] Inventor: Vincente Rodriguez Martin, Calleja De Naranjos, 2, 1 °D, 45002 Toledo, Spain

[21] Appl. No.: 09/318,960

[22] Filed: May 26, 1999

[51] Int. Cl.[7] ..... A47H 13/14

[52] U.S. Cl. ..... 24/716; 160/348; 24/326

[58] Field of Search ..... 24/716, DIG. 28, 24/370, 570, 67, 3.12, 3.1, 199, 198, 170; 160/348; 16/87.2

[56] References Cited

U.S. PATENT DOCUMENTS 2,685,113 8/1954 Roeckel ..... 160/348 X
3,090,533 5/1963 Claeys et al. ..... 160/348 X
3,214,788 11/1965 Poultney ..... 160/348 X
3,654,983 4/1972 Hachtel ..... 160/348
5,632,068 5/1997 Riley et al. ..... 24/326

*Primary Examiner*—James R. Brittain
*Assistant Examiner*—Robert J. Sandy
*Attorney, Agent, or Firm*—Harrison & Egbert

[57] ABSTRACT

A hook for pleating and hanging curtains, composes of preferably of a rectangular a plate having first and second edges opposed from each other, opposed parallel edges, and a series of grooves (2, 2', 3, 3', 4, 4', 5, 5') symmetrical about an axis (6) of the plate; the series of symmetrical grooves define two end grooves, two central grooves and a strip defining a small hanging leg, fabric of the curtain is adapted to be inserted through the series of symmetrical grooves in a labryrinthine way for forming a broad pleat and a fastening of the curtain.

4 Claims, 3 Drawing Sheets

III-III

V-V

VI-VI

VII-VII

VIII-VIII

HOOK FOR PLEATING AND HANGING CURTAINS

BACKGROUND OF THE INVENTION

The present specification refers to an application for a patent of invention related to a hook for pleating and hanging curtains, the purpose of which is to keep curtains in their strict sense hanged, determining, on the one hand, the pleat of the curtain and the corresponding height, being able to easily correct said parameters, while, on the other hand, the own hook is configured as the element necessary to directly hang the curtain, all this being performed with no need to make up any previous seam on the fabric which constitutes the curtain in question.

The hook for pleating and hanging curtains is configured as a part easily obtained, the manufacture of which does not require the use of complex tools and machinery.

FIELD OF THE INVENTION

This invention will find application within the industry dedicated to the manufacture of machinery, devices and auxiliary elements for curtains and similar.

RELATED ART

Different types of hooks for curtains are known, having been checked that all them present, as common denominator, an imperative need to make up a previous pleat and sewing on the curtain or to use a pleating ribbon, which must present special and adequate characteristics in relation to the hooks used, the pleating ribbon being previously fastened through a seam to the upper edge of the curtain.

Anyway, the curtain seam is unavoidable, with the very important participation of and, in addition, allowing for a minimal, practically null, margin for error, both in relation to the wide and the long of the curtains, measures that, once made up are unalterable.

The obvious solution to this problem would be to rely on a hook which could determine itself both the pleat and the height thereof, with the possibility to adjust these parameters, while, on the other side, the hook should be qualified to act as a direct link to hang the curtain in question, without any imperative need, at that moment, to make up a previous seam on the body of the curtain.

The invention considered as suitable should have, at the same time, the characteristic of being easily obtained, with no need to use complex devices and machines, to obtain a part having a low cost which could be used in a general way.

Nevertheless, the applicant is not aware of the existence, at present, of an invention which, configured with a hook for pleating and hanging of curtains, is fitted with the characteristics previously pointed out as suitable.

SUMMARY OF THE INVENTION

The hook for pleating and hanging curtains as proposed by the invention, is configured per se as an evident novelty within the specific field of application thereof, on presenting in its context all the particularities and advantages previously pointed out as suitable, having, at the same time, the peculiarity of allowing it to be easily manufactured.

In a most definite way, the hook for pleating and hanging curtains, which is the object of the present invention, is constituted starting from a body formed by a tough plate, for example, of a metallic or plastic nature, and having, preferably, a rectangular-shape.

This plate has, starting from two of its opposed edges, a series of grooves starting perpendicular from said edges, arriving up to the proximities of the opposed edge, taking symmetrical positions in relation to the axis of plate parallel to the grooves.

The series of said grooves is composed of two end grooves starting from a same edge and run next to the edges parallel to the plate, and a series of intermediate grooves, preferably in a number of six, starting from the opposed edge.

The two central grooves determine an intermediate strip having a reduced wide transversely adapted to determine a hanging small leg or claw, while the remaining intermediate and end grooves delimit tabs between which the fabric of the curtain will be inserted in a labyrinthine way, to determine the division in broad pleats and fastening thereof.

In use, the plate is so arranged that the end grooves are upwards, through the upper edge of the plate, so that the remaining grooves are directed downward, through the lower edge of the plate.

The end grooves delimit, with the free vertical edges of the plate, some end tabs over which the definite pleat, starting from the upper edge of the curtain, will be disposed astride, on adjusting the height of same, so avoiding any displacement downward because its own weight in relation to the hooks.

The remaining of the grooves determine a labyrinthine pass for the running of the curtain, including the upper pleat, once the pleat of said curtain has been determined, and collaborating with its fastening.

The fastening of the curtain to the hook is performed without any previous operation on same, only by a simply pleating its upper marginal part with the necessary magnitude to adequate the effective height of the curtain to the needs of the installation site, which allows the hook to be mounted and dismounted so many times as necessary, in order to correct installation errors, at the same time as this mounting, by simply pressure fitting allows, in addition, continuous hooks to be separated, in a greater or lesser amplitude, to regulate also the curtain height.

It is also an object of the present invention the fact that, optionally, the hook for pleating and hanging curtains can be configured starting from a part having a metallic nature, preferably, of course, replaceable by other material allowing it to be suitably formed and treated, the main body of the part presenting a rectangular base configuration, being folded by an imaginative transverse line and obtaining two identical adjacent zones joined one other by a curved strain zone, a protuberance having a length similar to two thirds the length of one of the adjacent and attached sides emerging from one of the sides, and on said protuberance a cut operation is performed in order to obtain at least four vertical right and parallel projections prsenting an identical or not wide, but always a similar length, in which the fabric constituting the curtain is inserted, so generating, with its appropiate incorporation, the pertinent pleating thereof, and obtaining the sought configuration from the object, which can optionally—present a wide protuberance in order to allow it to be suitably hanged.

DESCRIPTION OF THE DRAWINGS

In order to complement this description and to aid to a better understanding of the characteristics of the invention, the appending three sheets of drawings which are a part of this specification, show, by way of illustrative and non-limiting example, the following.

Figure 4:
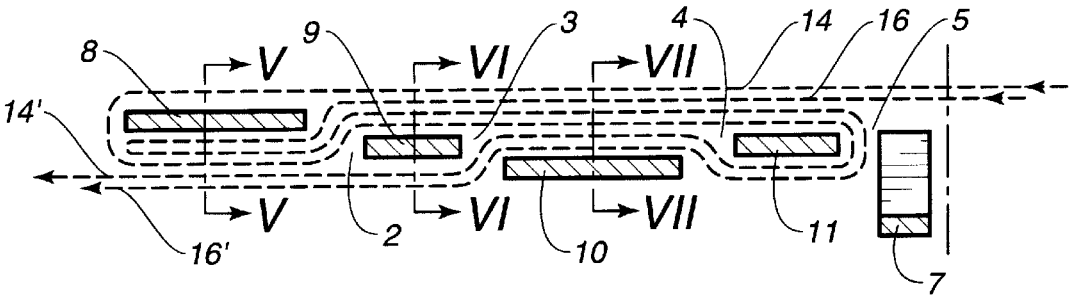
FIG. 4 shows a section similar to that represented in FIG. 3, at a greater scale, including only a half of the hook with the tabs transversely displaced, and showing by a continuous line the real path of the curtains.
Figure 5:
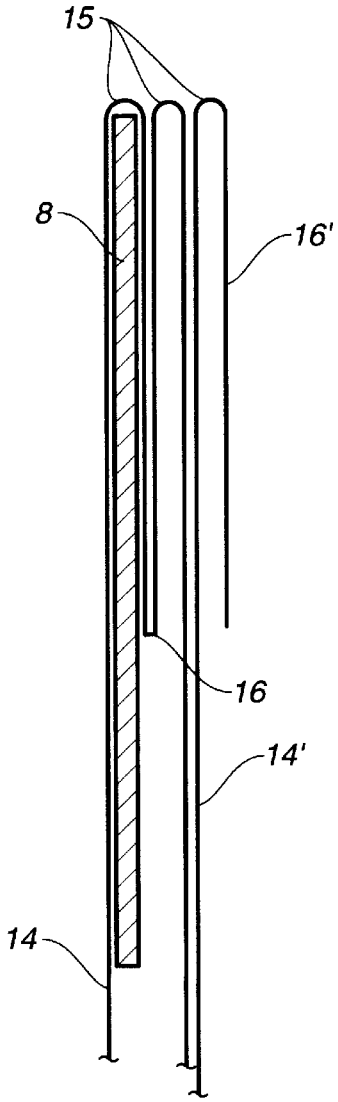
FIG. 5 corresponds to a view along V—V of the object shown in FIG. 4.
Figure 6:
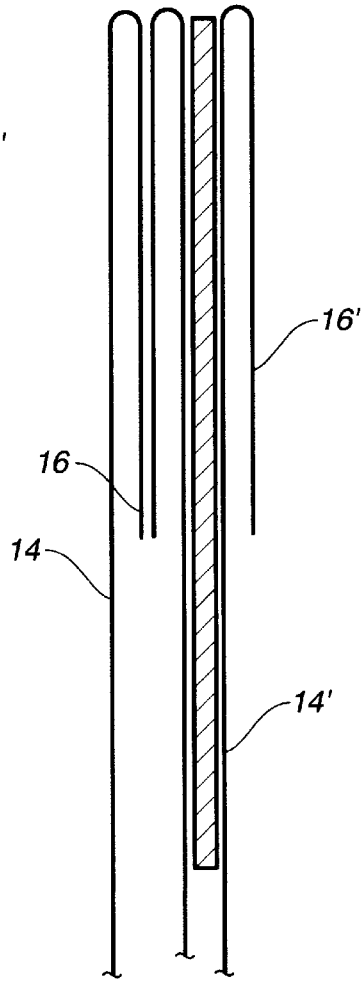
FIG. 6 shows a detail through VI—VI of the object shown in FIG. 4.
Figure 7:
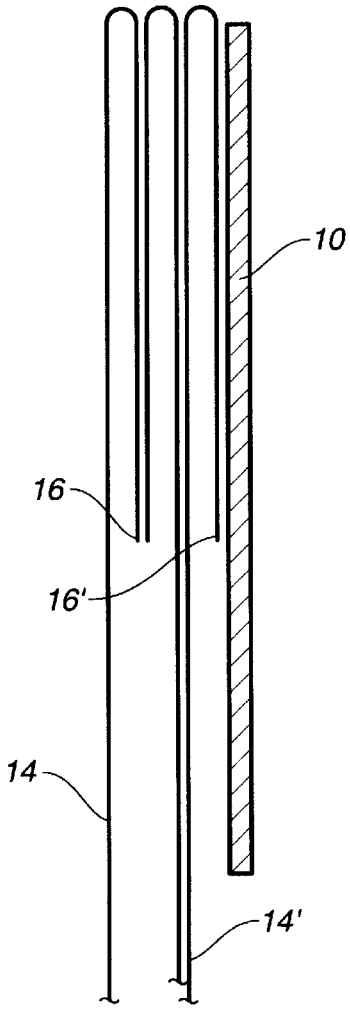
FIG. 7 shows a detail through VII—VII of the object shown in FIG. 4.

That is to say, FIGS. 5, 6 and 7, as shown, represent views of the FIG. 4, the sections of which are Roman numerals.

Figure 8:
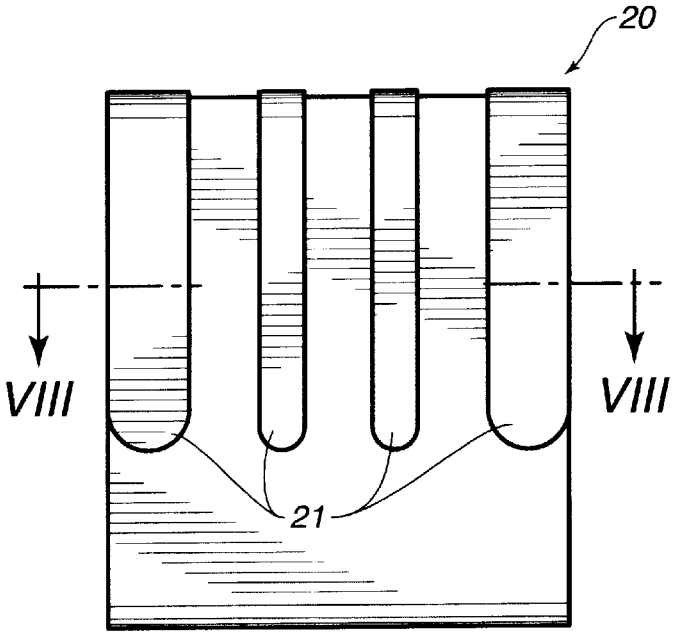

FIG. 8 corresponds to a second embodiment of the invention.

Figure 9:
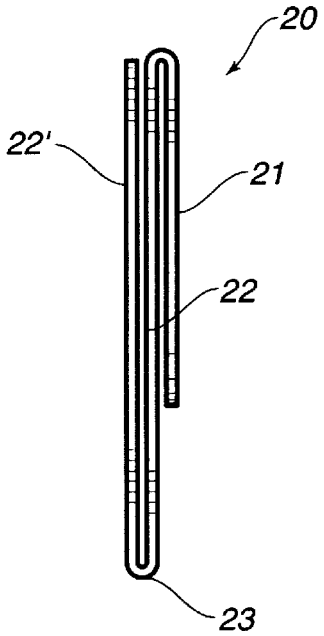

FIG. 9 shows a side elevational view of the object shown in FIG. 8.

Figure 10:
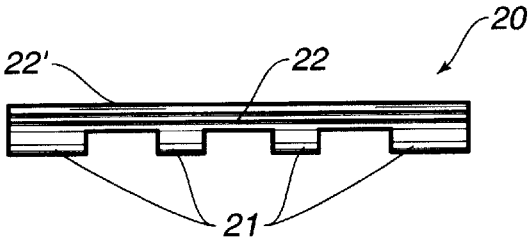

FIG. 10 corresponds to a plan view of the object shown in FIGS. 8 and 9.

Figure 11:
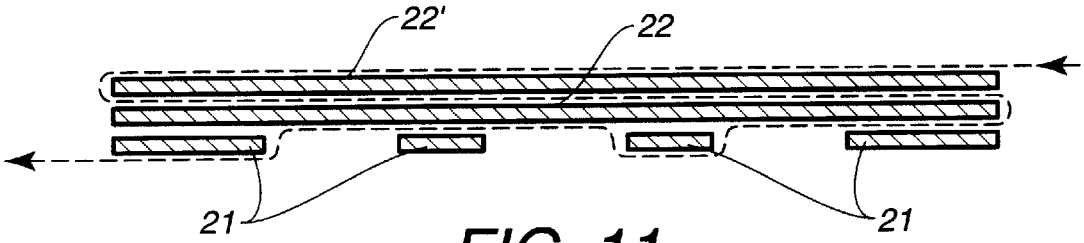

FIG. 11 shows, lastly, a view through VIII—VIII.

DESCRIPTION OF THE PREFERRED EMBODIMENT OF THE INVENTION

Figure 1:
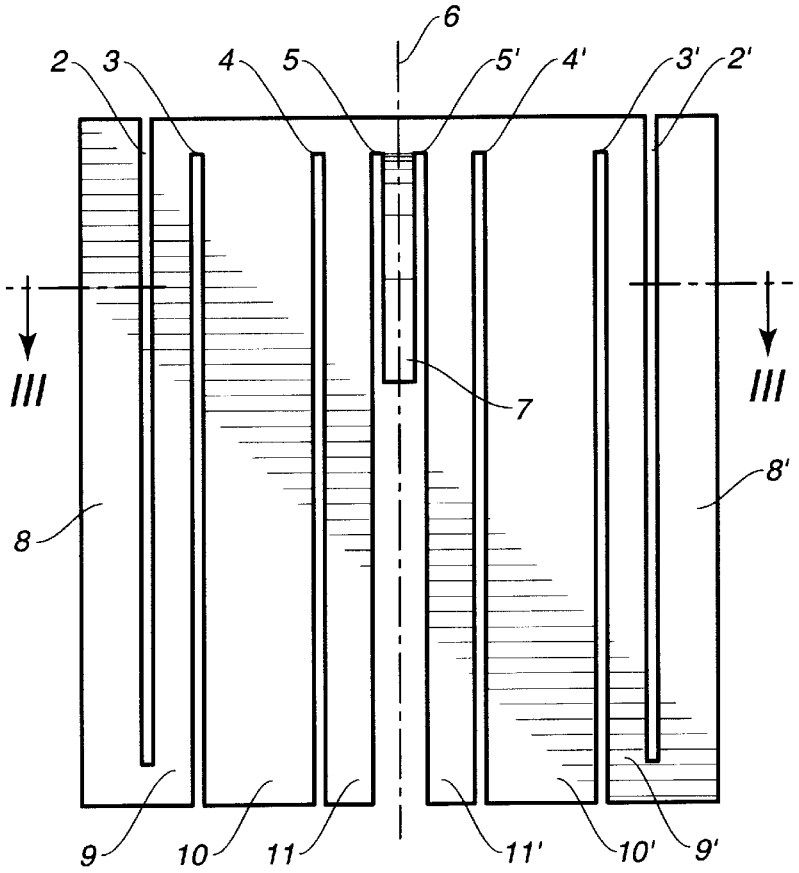
FIG. 1 corresponds to a front elevational view of a hook constituted according to the invention corresponding to a hook for pleating and hanging curtains.
Figure 2:
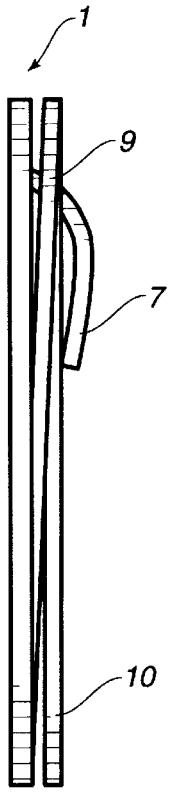
FIG. 2 is a cross section of the hook shown in FIG. 1.
Figure 3:
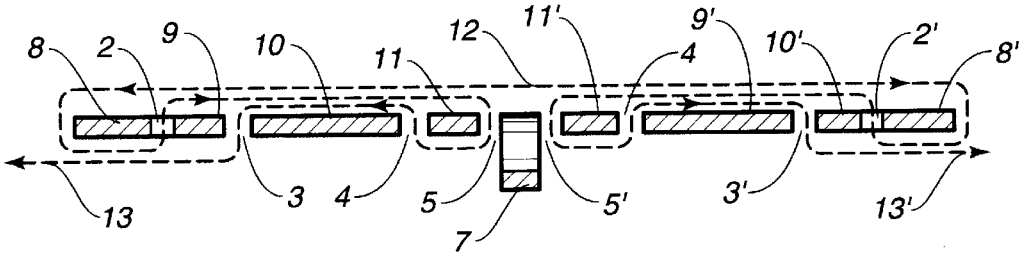
FIG. 3 corresponds to a cross section of the hook, taken along the cutting line III—III of FIG. 1, before shaping the plate and including, in a schematic way and by means of a discontinuous line, the path of the curtain.

As seen in FIGS. 1, 2 and 3, the hook for pleating and hanging curtains, is constituted by a tough plate (1), for example of a metallic or plastic nature, having preferably a rectangular shape, this plate presenting a series of grooves (2, 2'), (3, 3'), (4, 4') and (5, 5'), starting from two of the opposed edges, in a direction perpendicular to same, which arrive at the proximities of the opposed edge and are symmetrical in relation to the axis (6) of the plate (1) parallel to said grooves.

The two central grooves delimit a strip having a reduced width, which is transversely adapted and cuts to shape a small leg or pawl (7) which will define the hanged element.

The remaining grooves delimit two end fringes (8, 8') and a series of intermediate fringes (9, 9'),(10 10') and (11, 11'), all them also symmetrical in relation to the axis (6).

Starting from the base or start of the fringes (9, 9') and (10, 10'), the plate deforms or lightly folds in a transverse sense, so that the zone of the plate limited between the end grooves (2, 2') will form a sort of angle with regard the end fringes (8, 8'), while the fringes (10, 10') will form a certain angle with regard to the adjacent fringes (9, 9') and (11, 11'), all this such as shown in the cross section of FIG. 2.

In the working position, the hook is arranged in the position shown in FIGS. 1 and 2, the end grooves (2, 2') emerging through the upper edge of the plate, while the remaining grooves emerge starting the lower edge thereof.

With the above exposed construction, the mounting of the curtain on the hook will be effected following the path defined by a discontinuous line in FIG. 3, by running the curtain behind the hook by a section (12) which will define a pleat and the extensions of which will fold up on the vertical edges of the plate and being consecutively inserted through the grooves (2, 2'), (5, 5'), (4, 4') and (3, 3'), determining a path or labyrinthine course, and then to continue by both sides according to the extensions (13, 13') until arriving at the adjacent hooks, where the same path will be described.

To mount the curtain, it will be necessary first to adjust its height. This is attained by means of a pleat starting from the upper edge of same, so that the portion of curtain inserted between the fringe of the hook plate, at least in a part of its height, will include a double fabric.

FIGS. 4, 5, 6 and 7 show the path and position—of this double fabric of the curtain in relation to—the different fringes of the hook plate, and in these figures, the curtain is referenced with the numeral 14, while the upper pleat has been referenced with 15 and the flap or folded portion, with the numeral 16.

As seen in FIG. 4, the section (12) of the curtain running behind the hook plate is double, formed by the fabric of the own curtain (14), and by the pleat or flap, and on reaching this double fabric the end fringes (8, 8') of the hook are disposed riding on same, so that the pleat (15) rests on the upper edge of fringes (8, 8'), the fabric (14) of the curtain running on the exterior of fringe (8) and the fabric (16) of the flap or pleat on the interior, as shown in FIG. 4, continuing then both joined fabrics inserted through the groove (2), to pass behind the remaining fringes, both fabrics being inserted again through the groove (5), and the groove (4), passing behind the fringe (10) and emerging again through the groove (3), to continue now both fabric (14' and 16') until the next hook.

In all the path, the flap (16) is hidden by the curtain, and only the external fabric (14) of same and the pleats defined by sections (12) embraced by hooks are seen.

FIG. 5 shows the upper fold (15) of the curtain riding on the end fringes (8, 8'), the pleat (16) running behind said fringes, as well as the extension of the double fabric which will pass among the different fringes of the hook and output (14'–16') thereof toward the next hook.

In the case of fringes (9 and 11), the position of the double fabric is the same one, with two paths on a side and one path on the other side.

Following FIG. 7, one can see that the three paths of the double fabric run over the same side of the fringe (10).

The placement of the fabric is carried out in a very easy and fast way, since once the fabric has been folded, it is sufficient to insert it through the groove, with the described path due to the transverse strain of the fringes, in the exposed way the insertion and compression of the fabric is facilitated, so obtaining a perfect fastening.

As the double fabric is riding on the end fringes (8), its vertical positioning is assured in relation to the hooks, with no sliding risk.

Although in the above embodiment the plate includes seven grooves starting from one of its edges, this number of grooves could vary provided a labyrinthine path for the fabric between the plate fringes could be obtained permitting the formation of broad pleats on said fabric and a safe fastening of same.

In a second embodiment of the invention, shown in FIGS. 8, 9, 10 and 11, one can see that the hook for pleating and hanging curtains is configured starting from a part (20) constituting the hook in the strict sense, said part being formed by a sheet of metallic material or similar, subjected to a pleating operation through an imaginative transverse line (23) generating the existence of a curved zone, forming two similar bodies which are adjacent (22 and 22'), which are joined through the folding zone (23),as already stated, presenting on the opposed side an opening destined to allow any laminate element considered suitable to be inserted through it, the side (22) located at the opposed end , on being fitted with the folding zone (23), of a second folding zone (24) from which at least four protuberances (21) emerge, which can have equal width and length or can present a different width, being arranged in parallel and vertical, adjacent to the zone (22), and allowing the insertion into them of the curtain, in order to revise, starting from it, pleating and folding operations.

Accordingly, this invention presents a monoblock body in this second embodiment, obtained in a simplified way, from which protuberances destined to be used as folding links emerge, which, at option, can present a hanging link of any nature, located on the surface of the areas (22 or 22').

What is claimed is:

1. A hook for pleating and hanging curtains, comprising: a plate having a generally rectangular shape, a first opposed edge, and a second opposed edge opposed from the first opposed edge, opposed parallel edges, and a series of grooves (2, 2', 3, 3', 4, 4', 5, 5') symmetrical about an axis (6) of the plate;

the series of symmetrical grooves comprising: two end grooves (2 and 2') starting from the second opposed edge and running next to the parallel edges of the plate and arriving at a proximity of the first opposed edge, and a series of intermediate grooves (3, 3', 4, 4', 5, 5') starting from the first opposed edge and arriving at a proximity of the second opposed edge, and two central grooves (5, 5'); the two central grooves define a strip having a reduced width in which the strip performs as a small hanging leg or pawl (7), the two end grooves and a remaining two of the intermediate grooves define consecutive fringes (8, 8') in which fabric of the curtains is adapted to be inserted through the series of symmetrical grooves in a labryrinthine way to determine a broad pleat and fastening thereof.

2. The hook for pleating and hanging curtains according to claim 1, wherein the consecutive fringes have an inclination with respect to each other in an opposed direction extending from the second opposed edge.

3. The hook for pleating and hanging curtains according to claim 1, wherein the plate has a metallic nature and a rectangular base configuration; and wherein the hook (20) forms a laminar body defining two identical zones (22, 22') located adjacent to each other and formed by folding the laminar body through a folding line (23), the laminar body having at least four protuberances (21) in one (22) of the two identical zones extending from the folding line (23), the zone having the protuberances (21) forming a curvature (24).

4. The hook for pleating and hanging curtains according to claim 3, wherein the protuberances (21) have different widths and are positioned parallel to each other with identical lengths.

* * * * *